US008283003B2

(12) United States Patent
Morton-Finger

(10) Patent No.: US 8,283,003 B2
(45) Date of Patent: Oct. 9, 2012

(54) ARTIFICIAL TURF

(75) Inventor: Juergen Morton-Finger, Weinheim (DE)

(73) Assignee: Motech GmbH Technology & Systems, Ober-Abtsteinach (DE)

( * ) Notice: Subject to any disclaimer, the term of this patent is extended or adjusted under 35 U.S.C. 154(b) by 229 days.

(21) Appl. No.: 12/556,002

(22) Filed: Sep. 9, 2009

(65) Prior Publication Data

US 2010/0062192 A1 Mar. 11, 2010

(30) Foreign Application Priority Data

Sep. 9, 2008 (EP) ..... 08015877

(51) Int. Cl.
*D03D 27/00* (2006.01)

(52) U.S. Cl. ..... 428/17; 428/95; 428/364; 428/395

(58) Field of Classification Search ..... 428/15, 428/17, 95, 364, 395
See application file for complete search history.

(56) References Cited

U.S. PATENT DOCUMENTS

| | | | | | |
|---|---|---|---|---|---|
| 3,551,263 | A | * | 12/1970 | Carter et al. | 428/17 |
| 3,573,147 | A | * | 3/1971 | Elbert | 428/17 |
| 3,801,421 | A | * | 4/1974 | Allen et al. | 428/17 |
| 3,944,452 | A | * | 3/1976 | Toland et al. | 156/72 |
| 4,061,804 | A | * | 12/1977 | McCulloch | 428/17 |
| 4,617,208 | A | * | 10/1986 | Cadenhead, Sr. | 428/17 |
| 6,673,444 | B2 | * | 1/2004 | Yuuki et al. | 428/364 |
| 6,784,214 | B1 | | 8/2004 | Bacher et al. | 521/48 |
| 7,939,144 | B2 | * | 5/2011 | Verleyen | 428/17 |

FOREIGN PATENT DOCUMENTS

| | | | |
|---|---|---|---|
| DE | 3525441 | * | 1/1987 |
| JP | 2003268648 | | 9/2003 |

* cited by examiner

*Primary Examiner* — Cathy Lam
(74) *Attorney, Agent, or Firm* — Jonathan Myers; Andrew Wilford

(57) ABSTRACT

Artificial turf has a base layer, a multiplicity of blades fixed in and projecting upward from the base layer, and a mass of damping material on the base layer and through which the blades project. Each of the blades is at least partially formed of a polyester of terephthalic acid made from waste. The polyester is polyethylene terephthalate (PET) or polybutylene terephthalate (PBT), both from waste. The base layer is a flat primary layer, preferably a textile and preferably consists of plastic, a polyolefin and/or a polyester of terephthalic acid, preferably a polyester of terephthalic acid from waste.

12 Claims, 1 Drawing Sheet

ARTIFICIAL TURF

FIELD OF THE INVENTION

The present invention relates to artificial turf. More particularly this invention concerns artificial turf for use as a sport field, garden element, golf surface, or the like and comprising a base layer, a multiplicity of blades projecting up from and anchored in the base layer, and a mass of damping material on the layer through which the blades project. The invention also relates to a method of making such artificial turf.

BACKGROUND OF THE INVENTION

In artificial turf it has proven effective to fix fibers that are similar to natural blades of grass to a substrate and to fill the spaces between the fibers with a damping material. Shredded car tires are for example used as the damping material for filling. The disadvantage with such known artificial turf is that they do not have sufficient resilience and do not stand up again or do not stand up sufficiently after being loaded. Furthermore, the shredded car tires pollute the environment.

OBJECTS OF THE INVENTION

It is therefore an object of the present invention to provide an improved artificial turf.

Another object is the provision of such an improved artificial turf that overcomes the above-given disadvantages, in particular whose blades reliably stand up after being loaded over a long period, that has an outstanding appearance and a high level of environmental compatibility, that is simple to manufacture, and that can be made in a cost-effective manner.

Another object of the invention is to provide a method of making artificial turf.

SUMMARY OF THE INVENTION

Artificial turf has according to the invention a base layer, a multiplicity of blades fixed in and projecting upward from the base layer, and a mass of damping material on the base layer and through which the blades project. Each of the blades is at least partially formed of a polyester of terephthalic acid made from waste.

According to the invention the polyester is polyethylene terephthalate (PET) or polybutylene terephthalate (PBT), both from waste or recycled. The base layer is a flat primary layer, preferably a textile. The base layer preferably consists of plastic, a polyolefin and/or a polyester of terephthalic acid, preferably a recycled polyester of terephthalic acid.

The fact that the blades consist for the most part of at least one polyester of terephthalic acid from waste means within the scope of the invention that the blades contain at least 50% by weight, preferably at least 60% by weight, preferably at least 70% by weight, in the most preferred case at least 80% by weight and according to a particularly preferred embodiment at least 90% by weight of the polyester from waste. In the very preferred case, the blades consist entirely of the polyester of terephthalic acid from waste. It is in particular within the scope of the invention that the polyester from waste used according to the invention comes from used plastic bottles and/or films. The used plastic bottles are preferably shredded so that flakes are produced.

According to one embodiment, the blades contain at least one coloring agent and/or at least one UV stabilizer. An inorganic, mineral and/or organic coloring agent is preferably used as the coloring agent. It is within the scope of the invention that the coloring agent is incorporated into the blade and/or applied to the blade. It is recommended that at least one pigment that screens UV radiation and/or at least one additive that absorbs UV radiation is contained in the blades or applied to the blades as a coating as the UV stabilizer. The UV stabilizer has at least one part which is selected from the group consisting of benzotriazoles, benzophenones, and amine-based additives.

According to one variant, the blades are formed as single-part fibers. According to a preferred embodiment, the blades which are formed as single-part PET fibers from waste, the coloring agent and the UV stabilizer. In principle it is possible for the PET from waste to have in addition impurities, for example, coloring agents, other plastics or the like.

According to one variant, the blades are formed as multi-part fibers, preferably as two-part fibers. The multipart fibers preferably have a first plastic part and a second plastic part. It is recommended that the first plastic part and the second plastic part in each case form one part of the cross section of the multipart fibers, that is they are integrally bonded to each other. It is possible in principle for a third plastic part and where necessary a plurality or multiplicity of other plastic parts to form in each case one part of the cross section of the multipart fibers. The plastic parts preferably extend in each case over the entire length or essentially over the entire length of the blades or the multipart fibers. The multipart fibers preferably consist of just two plastic parts or are formed as two-part fibers.

According to a preferred embodiment, the multipart fibers have a core-sheath configuration. It is within the scope of the invention that the first or outer plastic part forms the sheath and the second or inner plastic part forms the core of a multipart fiber. It is recommended that the outer plastic part surrounds the inner plastic part at least in regions and preferably completely or essentially completely, and preferably over the entire length or essentially over the entire length of the multipart fiber. It is in principle also possible for the outer plastic part to surround the inner plastic part only over a section of the length of the multipart fiber. According to one embodiment of the artificial turf according to the invention, at least one intermediate plastic part is arranged between the outer plastic part and the inner plastic part, which intermediate plastic part preferably completely surrounds the inner plastic part and is in turn completely surrounded by the outer plastic part. The individual plastic parts of the multipart fiber can in principle also be arranged in other configurations, for example side by side or island in the sea.

It is recommended that the outer plastic part consists essentially of at least one plastic from the group "virgin PET, PET from waste, virgin PBT, PBT from waste". According to a preferred embodiment, the outer part consists exclusively of virgin PET and/or virgin PBT. It is however also possible for the outer part to consist exclusively of PET from waste or PBT from waste.

It is within the scope of the invention that the inner plastic part consists essentially of PET from waste and/or PBT from waste. It is possible that the inner plastic parts contains impurities such as coloring agents and/or other plastics and the like. According to one embodiment, the inner plastic part consists exclusively of PET from waste or PBT from waste.

The coloring agent and/or the UV stabilizer is preferably contained at least in the outer plastic part. In a particularly preferred embodiment, the coloring agent and/or the UV stabilizer are only in the outer plastic part or applied to the outer plastic part. In other words, the inner plastic part does not contain any coloring agent or UV stabilizer.

According to one embodiment, a bonding agent is arranged at least in regions between the outer plastic part and the inner plastic part. The bonding agent preferably surrounds the inner plastic part completely or essentially completely over the length of the multipart fiber as a third plastic part. The third plastic part is preferably surrounded by the outer plastic part completely or essentially completely over the entire length of the multipart fiber.

The damping material preferably consists of plastic fibers, the plastic fibers of the damping material being formed as single-part fibers or preferably as multipart fibers. According to one embodiment, the plastic fibers of the damping material are textured or crimped. It is within the scope of the invention that the damping-material fibers essentially contain at least one plastic selected from the group of virgin PET, PET from waste material, virgin PBT, and PBT from waste material. The damping material preferably contains at least one coloring agent and/or at least one UV stabilizer, the coloring agent and/or the UV stabilizer being incorporated into the damping material or applied to the damping material.

According to one embodiment, the plastic fibers of the damping material are entwined or twisted or down-twisted with a is yarn at least in sections and preferably completely or essentially completely. The yarn preferably consists entirely or essentially entirely of at least one part from the group of polyethylene (PE), polypropylene (PP), virgin PET, PET from waste, virgin PBT, PBT from waste, and polyamide (PA). The yarn can preferably be produced as a smooth or essentially smooth yarn by extrusion. According to one variant, the yarn and the plastic fibers of the damping material are fixed to the base layer independently of each other or adjacent to each other with different tufting needles. According to a further variant, the yarn and the plastic fibers of the damping material are fixed together to the base layer by one tufting needle. It is recommended that the damping material consists of textured plastic fibers. Twisted means within the context of the invention that the plastic fibers of the damping material are in each case turned with the yarn. Furthermore, down-twisted means within the context of the invention means that the plastic fibers of the damping material are wound with respective yarns. It is in principle possible for the yarn to be wound around or down-twisted with one plastic fiber of the damping material.

It has proven effective for the individual parts of the multipart fibers of the damping material in each case to form one part of the cross section of the multipart fiber. The individual parts preferably extend completely or essentially completely over the entire length of the multipart fibers of the damping material. It is recommended that the multipart fibers have a core-sheath configuration, wherein according to a preferred embodiment the sheath completely or essentially completely surrounds the core. The coloring agent and/or the UV stabilizer are preferably only arranged in the sheath or applied to the sheath. The core preferably consists for the most part, that more than 50% by weight, and preferably completely of PET from waste and/or PBT from waste. It is recommended that the sheath is produced for the most part, again more than 50% by weight, from virgin PET or virgin PBT.

The invention furthermore teaches a method of producing an artificial turf, wherein first at least one polyester of terephthalic acid from waste, in particular polyethylene terephthalate (PET) from waste and/or polybutylene terephthalate (PBT) from waste is crystallized and dried. This polyester of terephthalic acid is then mixed in an extruder with at least one coloring agent and/or at least one UV stabilizer. Blades of the artificial turf are then extruded as single-part fibers and preferably as multipart fibers. Finally the blades are fixed to a base layer. The polyester from waste is preferably fed to the extruder by means of a dosing device and preferably by means of a dosing screw. According to a preferred embodiment of the method according to the invention, the polyester from waste is mixed with the coloring agent and/or the UV stabilizer in the extruder. A single-screw extruder, double-screw extruder, multi-shaft extruder or planetary extruder can for example be used as the extruder.

According to one variant, multipart fibers are produced or extruded using at least one and preferably at least two extruders. The multipart fibers preferably have at least one polyester and preferably two different polyesters of terephthalic acid, which are selected from the group "virgin PET, PET from waste, virgin PBT, PBT from waste". According to a preferred embodiment of the method according to the invention, at least one part of the multipart fiber consists for the most part of PET from waste and/or PBT from waste. At least one part preferably and in the preferred case only one part of the multipart fibers contains the coloring agent and/or the UV stabilizer. It is within the scope of the invention that the blades are fixed to the base layer by tufting.

According to one embodiment, the extrusion of the multipart fibers is carried out with the proviso that the multipart fibers have a core-sheath configuration and that at least one outer sheath-forming plastic part of a blade contains the coloring agent and/or the UV stabilizer. It is within the scope of the invention that an inner core-forming plastic part does not contain any coloring agent or UV stabilizer. In other words, only the outer plastic part is mixed or coated with the coloring agent and/or the UV stabilizer.

It is within the scope of the invention that the polyester of terephthalic acid from waste is mixed in the extruder with at least one chain extender. The chain extender preferably bonds to a terminal functional group of a first molecule of the polyester and binds the first molecule with a second molecule of the polyester. Two preferably different molecules of a polyester of terephthalic acid are bonded to each other in this manner, as a result of which an extension of the polymeric molecular backbone is produced. The chain extender preferably contains at least one substance which is selected from the group of lactam derivatives, oxazole derivatives, and caprolactam derivatives.

According to one embodiment, the polyester of terephthalic acid from waste is dried in an extruder, which is selected from the group of single-screw extruder, double-screw extruder, multi-shaft extruder, and planetary extruder. In a preferred embodiment, the polyester of terephthalic acid is dried in a multi-shaft extruder or planetary extruder. It lies within the scope of the invention that the double-screw extruder is operated in an underfed manner with the proviso that only 20% to 60%, preferably 30% to 50% of the screw channels are filled with the polyester of terephthalic acid from waste. The polyester of terephthalic acid from waste is preferably fed to the double-screw extruder by means of the dosing device. Both extruder screws of the double-screw extruder preferably have the same direction of rotation. The extruder interior is preferably attached to a vacuum pump whose he operation causes the pressure in the extruder interior to be reduced. Low-molecular compounds and water are preferably drawn out or removed from the polyester of terephthalic acid in the extruder interior under reduced pressure. According to a preferred embodiment of the method according to the invention, the preferably crystallized and preferably not predried polyester of terephthalic acid from waste is fed to the double-screw extruder by means of the dosing device.

A mass of damping material is preferably arranged on the base layer between the blades. It is within the scope of the invention that the damping material consists of single-part fibers and preferably of multipart fibers. The single-part fibers or the multipart fibers of the damping material are preferably produced as textured or crimped single-part fibers or multi-part fibers by extrusion through a compression chamber. According to one embodiment, the single-part fibers consist for the most part and preferably completely of the polyester of terephthalic acid from waste.

It is recommended that the multipart fibers of the damping material also have a core-sheath configuration. A core preferably consists for the most part and preferably completely of the polyester of terephthalic acid from waste and is preferably completely or essentially completely surrounded by a sheath. According to one embodiment, the sheath consists essentially of a virgin polyester of terephthalic acid. It is in principle possible for the sheath also to be fabricated from a polyester of terephthalic acid from waste. According to a preferred embodiment of the method according to the invention, the coloring agent and/or the UV stabilizer is only incorporated in the sheath or applied to the sheath.

The invention is based on the finding that the artificial turf according to the invention has a surprisingly high load capacity. This means in particular that the blades have a high resilience or elasticity. If an artificial turf according to the invention is subjected to frequent loading during which the blades are regularly bent over, the blades stand up again completely. As a result the artificial turf according to the invention furthermore has an appealing or optimal appearance even after a long service life or use time. Essential to the invention is also that the artificial turf according to the invention has outstanding damping properties. The damping material according to the invention is also characterized by outstanding skin-friendliness, as a result of which the risk of injury for persons who for example fall on the artificial turf is very low. This is achieved among other things by the formation of the textured fibers which form the damping material. Furthermore, the environmental compatibility of the artificial turf according to the invention is non-critical.

Furthermore, the invention is based on the discovery that the artificial turf according to the invention can be produced without problems from easily available and cost-effective source materials by the method according to the invention. It is furthermore advantageous that in particular the visual quality of the cores of the multipart fibers, which can be used as blades and as damping material, has no or essentially no effect on the appearance of the artificial turf.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
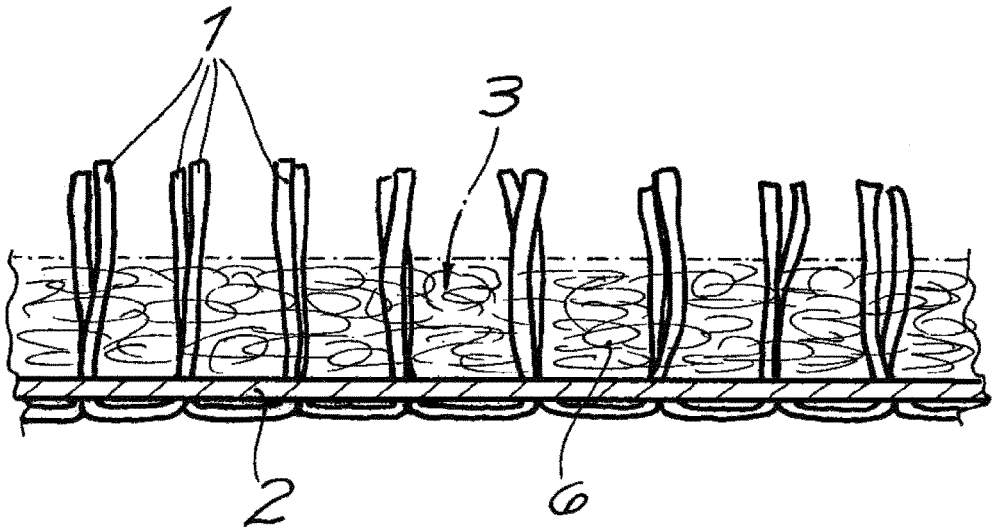
FIG. 1 is a schematic vertical section through a piece of artificial turf according to the invention.

As seen in FIG. 1 artificial turf according to the invention has blades 1 fixed to a base layer 2. Here the base layer 2 is a textile. A mass 3 of damping material according to the invention is provided on the base layer 2 between the lower portions of the blades 1.

Figure 2:
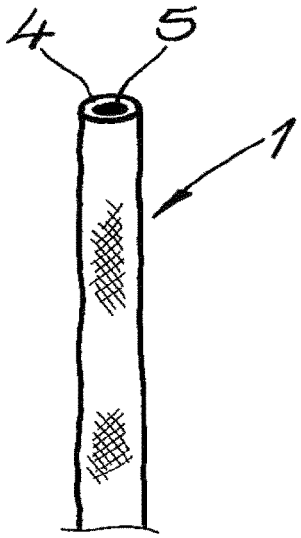
FIG. 2 is a large-scale perspective view of a blade of the turf.

FIG. 2 shows that a blade 1 according to the invention in the illustrated embodiment is formed as a two-part fiber with a core-sheath configuration. In the illustrated embodiment, an outer plastic part forms the core 5 and consists of PET made from waste. An inner plastic part forms the sheath 4 of the two-part fiber and consists of virgin PET. The inner plastic part forming the sheath 4 also contains a coloring agent and a UV stabilizer.

Figure 3:
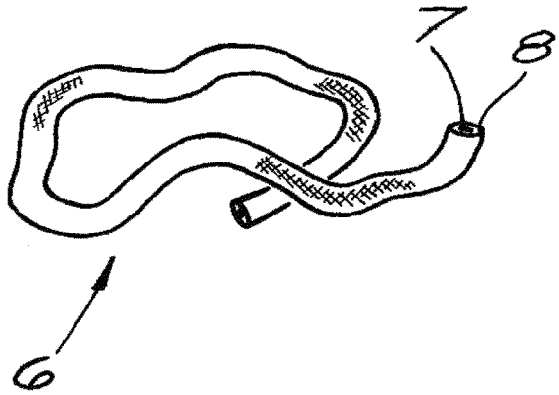
FIG. 3 is a perspective view of a multipart fiber of the damping material in accordance with the invention.

FIG. 3 shows a two-part fiber 6 of the damping-material mass 3 according to the invention that also has a core-sheath configuration. Preferably and in the illustrated embodiment according to FIG. 3, its core 7 consists of PET from waste while its sheath 8 consists of virgin PET that has been mixed with a coloring agent and a UV stabilizer. It can further be seen in FIG. 3 that the two-part fiber 6 of the damping-material mass 3 is textured or crimped. As a result the two-part fiber 6 of the damping-material mass 3 has a high elasticity and restoring force, so that the blades that project beyond the mass 3 of damping material are reliably erected again after their outer ends have been bent over for example when the artificial turf is treaded on.

I claim:

1. Artificial turf comprising:

a base layer;

a multiplicity of blades each being formed of a fiber comprising two components and having a core-sheath configuration, said blades being formed from a polyester of terephthalic acid wherein the polyester of terephthalic acid is selected from the group consisting of polyethylene terephthalate and polybutylene terephthalate, wherein the multiplicity of blades are affixed to the base layer and extend upward out of the base layer, such that the blades are each formed at least partially from the polyester of terephthalic acid, said polyester of terephthalic acid being obtained from waste materials; and a damping material is arranged on the base layer with the blades extending there through.

2. The artificial turf defined in claim 1 wherein the blades each contain at least one coloring agent or at least one UV stabilizer.

3. The artificial turf defined in claim 1 wherein each blade has a sheath formed of virgin polyethylene terephthalate, polyethylene terephthalate from waste, virgin polybutylene terephthalate, or polybutylene terephthalate from waste.

4. The artificial turf defined in claim 3 wherein each blade has a core formed of polyethylene terephthalate from waste or polybutylene terephthalate from waste.

5. The artificial turf defined in claim 3 wherein each sheath contains a coloring agent or a UV stabilizer.

6. The artificial turf defined in claim 1 wherein the damping material is formed of multipart fibers.

7. Artificial turf comprising:

(a) a base layer;

(b) a multiplicity of blades fixed in and projected upward from the base layer, each of said blades being at least partially formed of a polyester of terephthalic acid made from waste;

(c) a mass of damping material on the base layer and through which the blades project, wherein the damping material is formed of single-part fibers or multi-part fibers consisting essentially of at least one plastic selected from the group consisting of virgin PET, PET from waste material, virgin PBT and PBT from waste material; and (d) a yarn which consists essentially of at least one polymer selected from the group consisting of polyethylene, polypropylene, virgin PET, PET from waste, virgin PBT, PBT from waste, and polyamide, wherein the single-part fibers or multi-part fibers of the damping material are entwined or twisted or down-twisted with the yarn, at least in sections, and wherein the damping material and the yarn are each affixed to the base layer.

8. The artificial turf defined in claim 7 wherein the blades are multi-part fibers.

9. The artificial turf defined in claim 8 wherein each blade is a two-part core-sheath fiber.

10. The artificial turf defined in claim 9 wherein each blade has a sheath formed of virgin polyethylene terephthalate, polyethylene terephthalate from waste, virgin polybutylene terephthalate, or polybutylene terephthalate from waste.

11. The artificial turf defined in claim 10 wherein each blade has a core formed of polyethylene terephthalate from waste or polybutylene terephthalate from waste.

12. The artificial turf defined in claim 7 wherein the damping material is formed of multi-part fibers.

* * * * *